US006199566B1

(12) United States Patent
Gazewood

(10) Patent No.: US 6,199,566 B1
(45) Date of Patent: Mar. 13, 2001

(54) APPARATUS FOR JETTING A FLUID

(76) Inventor: Michael J Gazewood, 402 Machine Loop, Scott, LA (US) 70583

( * ) Notice: Subject to any disclaimer, the term of this patent is extended or adjusted under 35 U.S.C. 154(b) by 0 days.

(21) Appl. No.: 09/301,911

(22) Filed: Apr. 29, 1999

(51) Int. Cl.[7] ..... B08B 9/02; B05B 7/04

(52) U.S. Cl. ..... 134/166 C; 134/169 C; 239/403; 239/559; 239/560; 239/419.5

(58) Field of Search ..... 134/22.12, 24, 134/166 C, 169 C; 239/556, 558, 559, 419, 419.5, 428.5, 560, 561, 429, 403, 427, 427.3

(56) References Cited

U.S. PATENT DOCUMENTS

| | | | | |
|---|---|---|---|---|
| 2,735,794 | * | 2/1956 | Pletcher | 134/24 |
| 2,933,259 | * | 4/1960 | Raskin | 239/405 |
| 4,909,325 | * | 3/1990 | Hopmann | 134/24 |
| 5,794,857 | * | 8/1998 | Chen et al. | 239/430 |
| 5,979,799 | * | 11/1999 | Chen et al. | 239/430 |

OTHER PUBLICATIONS

Petroleum Engineering Handbook, Second Printing, Society of Petroleum Engineers, pp. 6–33 and 6–46, Jun. 1989.

* cited by examiner

*Primary Examiner*—Randy Gulakowski
*Assistant Examiner*—Saeed Chaudhry
(74) *Attorney, Agent, or Firm*—Dominque & Waddell, PLC

(57) ABSTRACT

An apparatus for jetting a fluid within a tubular member. The apparatus may comprise a cylindrical member having an outer portion and an inner portion, an outer sleeve disposed about the cylindrical member forming an annulus area, and a venturi device for jetting the fluid against the inner diameter walls of the tubular string. The venturi device comprises a nozzle disposed within the cylindrical member and a throat formed within the outer sleeve. A recirculation port is formed on the outer sleeve for communicating the fluid from a second annulus area to a first annulus area adjacent the throat. Also disclosed is a method of cleaning a tubular string with a power medium. The method includes providing a wash apparatus concentrically positioned within the tubular string. The power medium may be a fluid or air. In the preferred embodiment, the power medium is a fluid. The method further comprises circulating the power medium down the inner portion of the cylindrical member and exiting the power medium from the nozzle. An area of low pressure is formed at the tip of the nozzle within the first annulus area which causes fluid from the second annulus to enter the first annulus via the recirculation passage and thereafter mixing the power medium and fluid within the throat. Thereafter, the mixture is exited from the throat.

13 Claims, 12 Drawing Sheets

SECTION A

SECTION B

SECTION C

SECTION D

SECTION E

APPARATUS FOR JETTING A FLUID

BACKGROUND OF THE INVENTION

This invention relates to an apparatus and method for jetting a fluid. More particularly, but not by way of limitation, this invention relates to an apparatus and method for jetting a fluid into a container such as a tubular member in order to chemically treat and/or wash the tubular member.

In the oil and gas industry, tubular members are utilized to deliver hydrocarbons and water in a variety of different settings. For instance, an oil and gas well bore may be drilled to a subterranean reservoir. The tubular member is placed in the well bore and can be used as a conduit to produce oil, gas and water. As another example, pipelines are utilized in order to deliver produced hydrocarbons from one site to another site.

As those of ordinary skill in the art will recognize, these tubular members are susceptible to corrosion and deposition of materials such as scale. Operators find it necessary to attempt to prevent these problems, or alteratively, in those cases were it has already occurred, to attempt to clean the tubular member.

In the prior art, various devices have been attempted to treat and/or wash tubular members. These include casing scrapers that comprise a pad mounted on a cylindrical body, with the pad designed to scrape the tubular walls. Additionally, the prior art has developed a device known as a pig that is essentially a spherical member with scrapers thereon. The pig is inserted into tubular member and pumped from a first location to a second location in an attempt to clean the inner diameter of the tubular member. However, all these prior art devices lack the ability to adequate circulate a treating chemical and/or clean the walls of the tubular string.

Therefore, there is a need for an apparatus and method that will adequately jet, circulate, and recirculate treating fluids at the desired point of treatment in the well bore. There is also a need for an apparatus and method that will remove scale and other depositions of materials on walls of tubular members. These and other needs will be met by the present invention as will be apparent from a reading of the description of the invention.

SUMMARY OF THE INVENTION

An apparatus for jetting a fluid within a tubular string is disclosed. The apparatus may comprise a cylindrical member having an outer portion and an inner portion, an outer sleeve disposed about the cylindrical member forming an annulus area, and a venturi means for jetting the fluid against the inner diameter walls of the tubular string.

In the preferred embodiment, the venturi means comprises a nozzle disposed within the cylindrical member and a throat formed within the outer sleeve, and wherein the throat is aligned with the nozzle. Also included in the preferred embodiment is a recirculation port formed on the outer sleeve for communicating the fluid from a second annulus area to a first annulus area adjacent the throat.

In one embodiment, the venturi means contains a plurality of nozzles and throats, with the nozzles being configured within the cylindrical member and throats being configured on the outer sleeve. In another embodiment, the plurality of nozzles are oriented at an offset angle relative to the center axis of the cylindrical member. Additionally, the plurality of passageways forming the plurality of throats are oriented at an angle corresponding to the plurality of nozzles.

In another embodiment, some of the plurality of nozzles face radially outward toward the tubular string's inner diameter wall and at least one nozzle is rotated 90 degrees downward to project longitudinally downward relative to the center axis of the cylindrical member.

In one of the disclosed embodiments, the cylindrical member is connected to a drill string concentrically placed within the tubular string. In yet another embodiment, the cylindrical member is connected to a coiled tubing string concentrically placed within the tubular string.

Also disclosed is a method of cleaning a tubular string with a power medium. The method includes providing a wash apparatus concentrically positioned within the tubular string. The wash apparatus comprises a cylindrical member, a nozzle formed within the cylindrical member, an outer sleeve disposed about the cylindrical member forming a first and second annulus area, a throat formed on the outer sleeve, with the throat being aligned with the nozzle, and, a recirculation passage located on the outer sleeve. The power medium may be a fluid or air. In the preferred embodiment, the power medium is a fluid.

The method further comprises circulating the power medium down the inner portion of the cylindrical member and exiting the power medium from the nozzle. An area of low pressure is formed at the tip of the nozzle within the first annulus area which causes fluid from the second annulus to enter the first annulus via the recirculation passage and thereafter mixing the power medium and fluid within the throat. Thereafter, the mixture is exited from the throat.

In the preferred embodiment, the cylindrical member contains a plurality of nozzles, and the outer sleeve contains a plurality of corresponding throats. With this embodiment, the method further includes exiting the fluid from the plurality of nozzles. An area of low pressure is formed within the first annulus area and fluid within the second annulus area is drawn into the first annulus area. Thereafter, the power medium and fluid enters the throat and is mixed therein. Next, the fluid is exited from the plurality of throats.

In one of the embodiments disclosed, the plurality of nozzles and the plurality of throats are oriented at an off set angle relative to the center of axis of the cylindrical member. With this embodiment, the method includes exiting the fluid in a swirling pattern from the plurality of corresponding throats.

In yet another embodiment, at least one of the plurality of nozzles faces radially outward toward the tubular string's inner diameter walls and wherein at least one of the plurality of nozzles is rotated 90 degrees to project longitudinally downward relative to the center of axis of the cylindrical member. With this embodiment, the method includes exiting the fluid from the plurality of radially projecting throats thereby striking the inner diameter wall of the tubular string. Also included with this embodiment is that the fluid will exit from the downwardly projected throats relative to the center of axis of said cylindrical member.

In still another embodiment, the operator may find it desirable to chemically treat the tubular member. The purpose for treating may be corrosion control, scale removal, etc. Thus, the method would include pumping a chemical down the inner portion of the cylindrical member. The chemical slurry being pumped down becomes in effect the power medium. The chemical is then jetted, according to the teachings of the present invention, into the walls of the tubular member and into the second annulus area. The treating chemical may be selected from the group consisting of solvents for paraffin and scale removal, acid compounds for subterranean reservoirs, or chelate agents.

An advantage of the present invention includes the venturi means allowing for high pressure energy transfer between the power medium and the fluid that is in place in the annulus. Another advantage is that the novel device and method allow for a recirculation pattern of fluid within the annulus.

Still yet another advantage is that the power medium being pumped down hole may be a fluid composition that contains chemicals for treating the tubular member and/or perforations. Yet another advantage is that the device and method may be used to treat down hole well bores, surface pipe lines, flow lines, etc. It is also possible to wash perforations contained within the tubular member in the case of a subterranean well.

A feature of the present invention includes use of a venturi device for jetting and recirculating fluid contained within the annulus of the tubular member. Another feature is that the apparatus of the present invention may be run on work strings including drill strings, production strings and/or coiled tubing strings. Yet another feature includes having a plurality of nozzles operatively associated with a plurality of throats on the device.

Still yet another feature is that the apparatus includes an inner cylindrical member concentrically disposed within a sleeve. Another feature includes venturi jets that point radially outward as well as longitudinally downward from the bottom face of the apparatus. Yet another feature is that in a second embodiment, the nozzles and throats may be inclined at an offset angle so that a swirling action may be imparted to the fluid in the annulus.

DETAILED DESCRIPTION OF THE PREFERRED EMBODIMENTS

Figure 1:
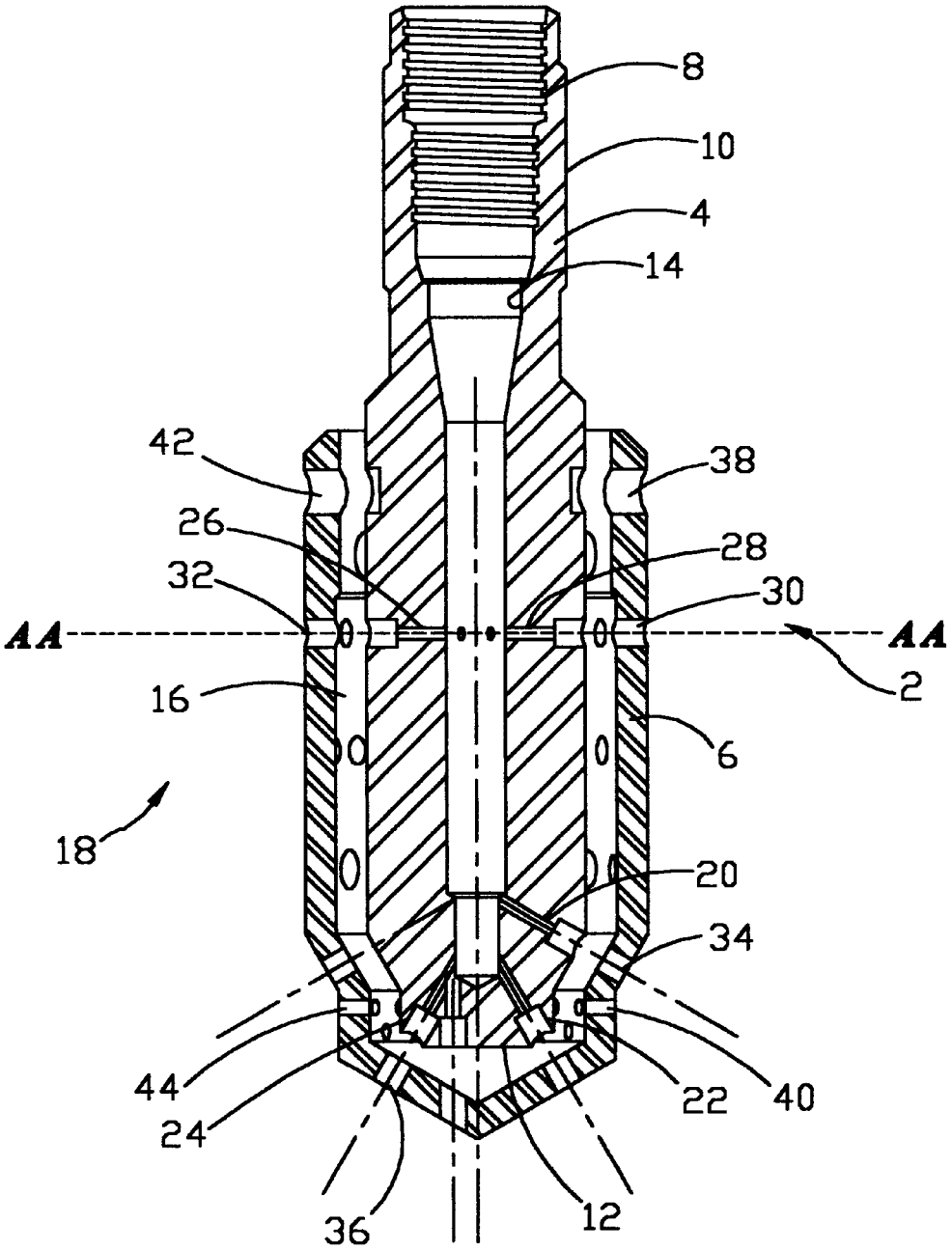
FIG. 1 is a cross-sectional view of the preferred embodiment of the present invention.

Referring now to FIG. 1, a cross-sectional view of the preferred embodiment of the present invention will now be discussed. The apparatus 2 generally includes a cylindrical member 4 that has disposed thereon the outer sleeve 6. As will be more fully described, the cylindrical member 4 has at one end the inner thread means 8. The inner thread means may be connected to a work string such as a drill string, production string, coiled tubing string, etc. The apparatus 2 can be concentrically placed within a production string, casing string, pipeline, flow line, tubular member or container.

As noted in FIG. 1, the cylindrical member 4 has a generally cylindrical outer diameter 10 that concludes at the end 12. The cylindrical member 4 also contains the inner bore 14. The concentrically disposed cylindrical member 4 creates a first annulus area 16. The apparatus disposed within the tubular member such as the casing string creates a second annulus area denoted as area 18.

The cylindrical member 4 has contained thereon a plurality of passages therethrough, with the passages containing nozzles 20, 22, 24, 26, 28. The outer sleeve 6 will also contain a plurality of passages, some of which will correspond to a throat for the venturi nozzles, while others will be recirculation ports for the communication of fluid from the second annulus to the first annulus as will be more fully explained later in the application. For instance, FIG. 1 depicts throats 30, 32, 34, 36 as well the recirculation passages 38, 40, 42, 44. In one of the embodiments, the diameter of the throats are generally equal to the diameter of the nozzles.

Figure 2:
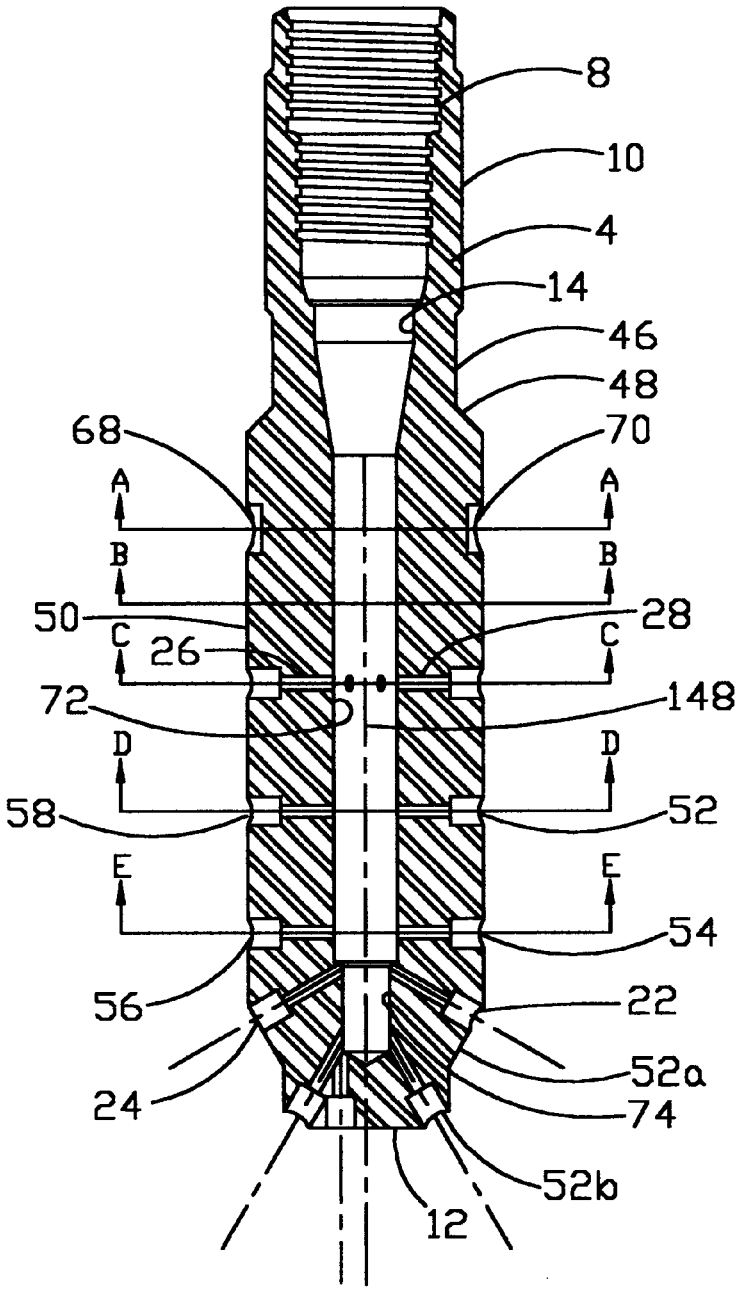
FIG. 2 is a cross-sectional view of the cylindrical member seen in FIG. 1.

Referring now to FIG. 2, the cylindrical member 4 will be described in greater detail. It should be noted that like numbers referred to in the various figures refer to like components. Thus, the outer cylindrical surface 10 extends to the first outer surface 46 that in turn extends to the chamfered shoulder 48 that in turn will extend to the second outer cylindrical surface 50. The outer surface 50 extends to the first chamfered surface 52*a* and the second chamfered surface 52*b* that will conclude at the end 12.

The surface 50 has contained therethrough the previously mentioned passageways 26, 28 for placement of the venturi nozzles. Additionally, FIG. 2 also shows the passageways 53, 54, 56, 58 wherein the venturi nozzle is positioned therein. As shown, the passageways include a first smooth bore that extends to enlarged threaded bore, with the nozzle member being capable of threadedly mating within said threaded bore. In one of the embodiments, the nozzle is simply a bore hole, such as a conical bore hole drilled into the walls of the cylindrical member 4.

FIG. 2 also includes passageways 60, 62 that are included within the surface 52. The end face 12 has therein the passageways 64, 66. The passageways 60, 62, 64, 66 will contain therein nozzles as previously described. As depicted in the various figures, the passageways communicate the inner bore 14 with the outer portion of the cylindrical member 4. Additionally, outer surface 50 contains indentations 68, 70 for purpose of mounting a pin therein for affixing the outer sleeve 6 to the member 4. The first inner bore 14 will narrow to the second inner bore 72 which in turn extends to the third inner bore 74.

Figure 3:
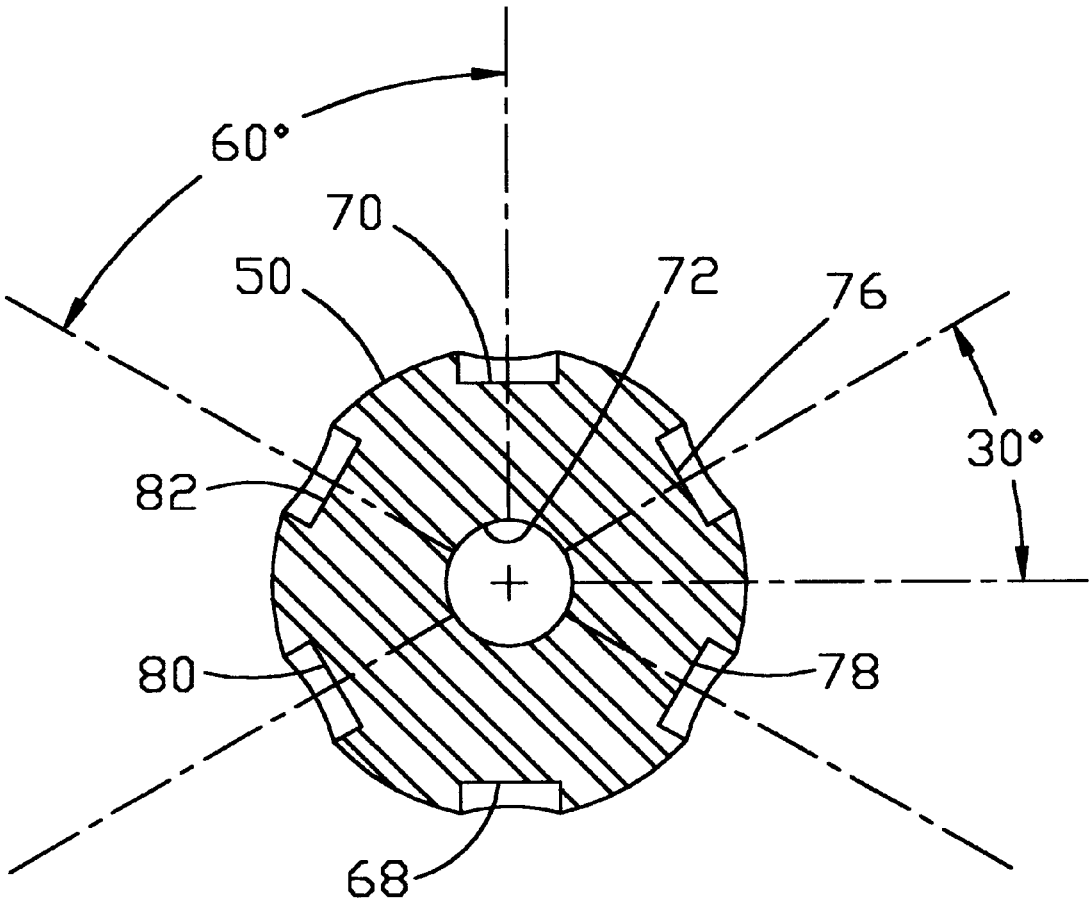
FIG. 3 is a cross-sectional view of the cylindrical member of FIG. 2 taken along line A—A.
Figure 4:
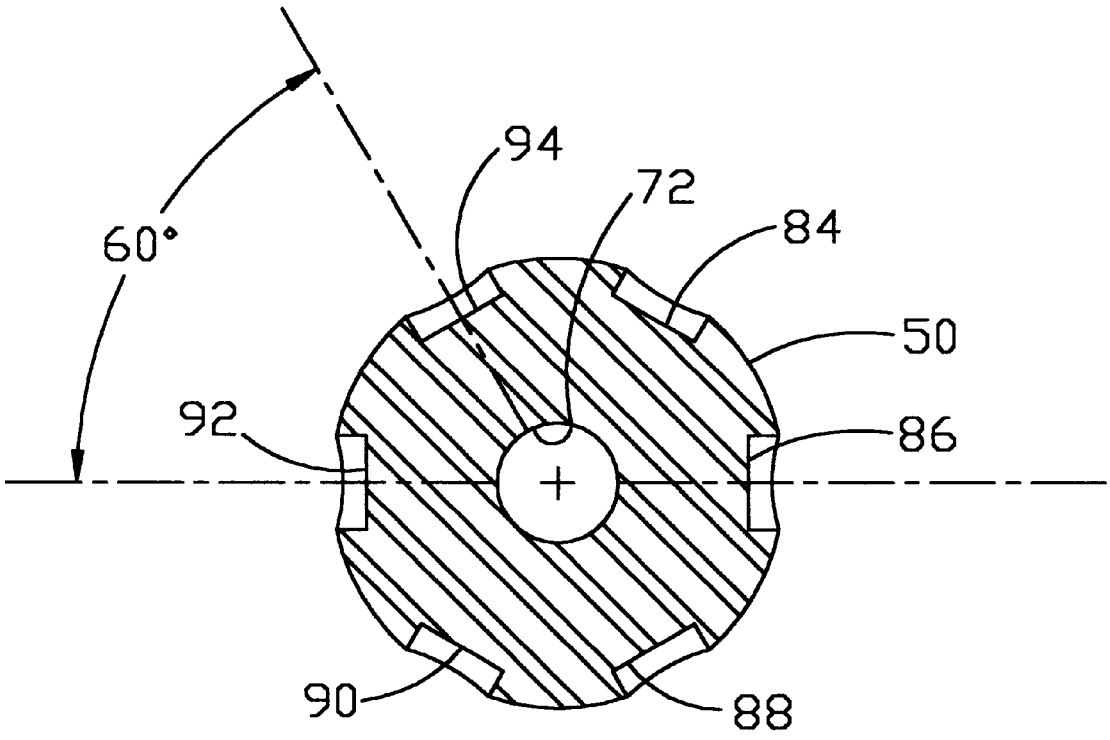
FIG. 4 is a cross-sectional view of the cylindrical member of FIG. 2 taken along line B—B.

With reference to FIG. 3, the cross-sectional view of cylindrical member 4 through line A—A of FIG. 2 will now be described. The FIG. 3 depicts the indentations 76, 78, 80, 82. Likewise, FIG. 4 depicts the cross-sectional view of cylindrical member 4 through line B—B with the indentations 84, 86, 88, 90, 92, 94.

Figure 5:
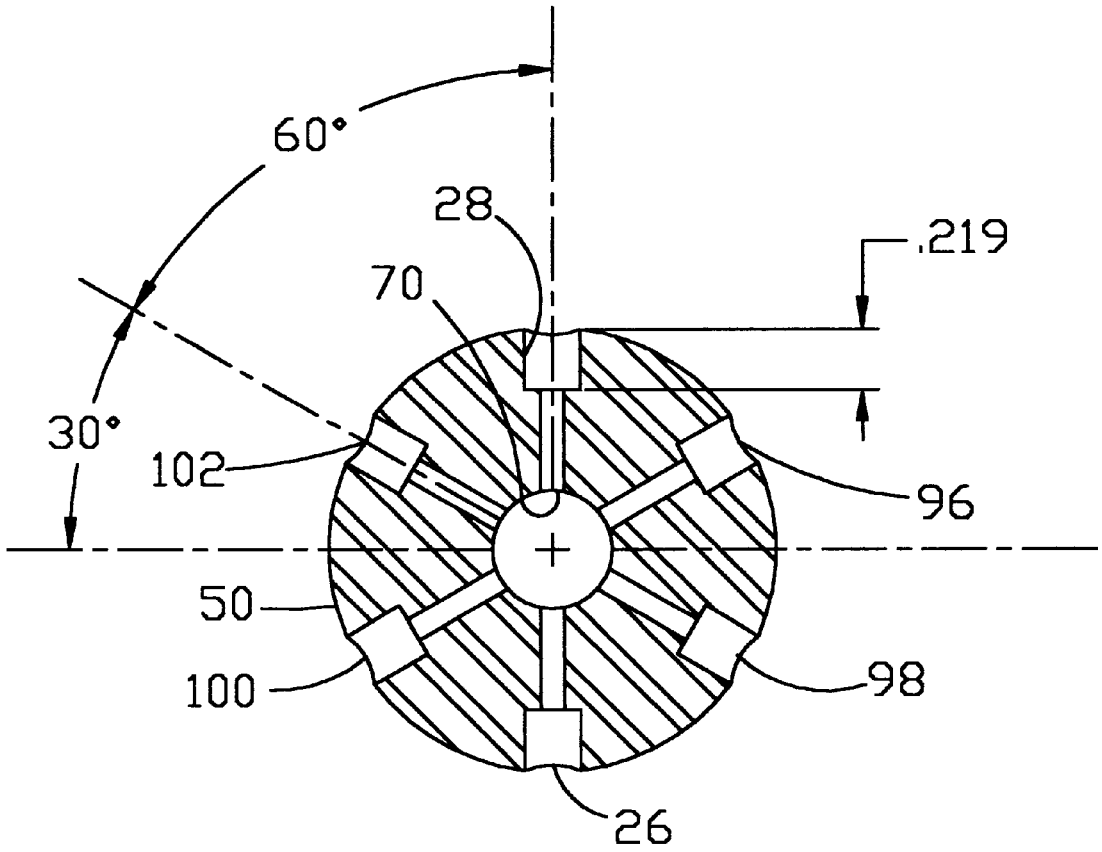
FIG. 5 is a cross-sectional view of the cylindrical member of FIG. 2 taken along line C—C.
Figure 6:
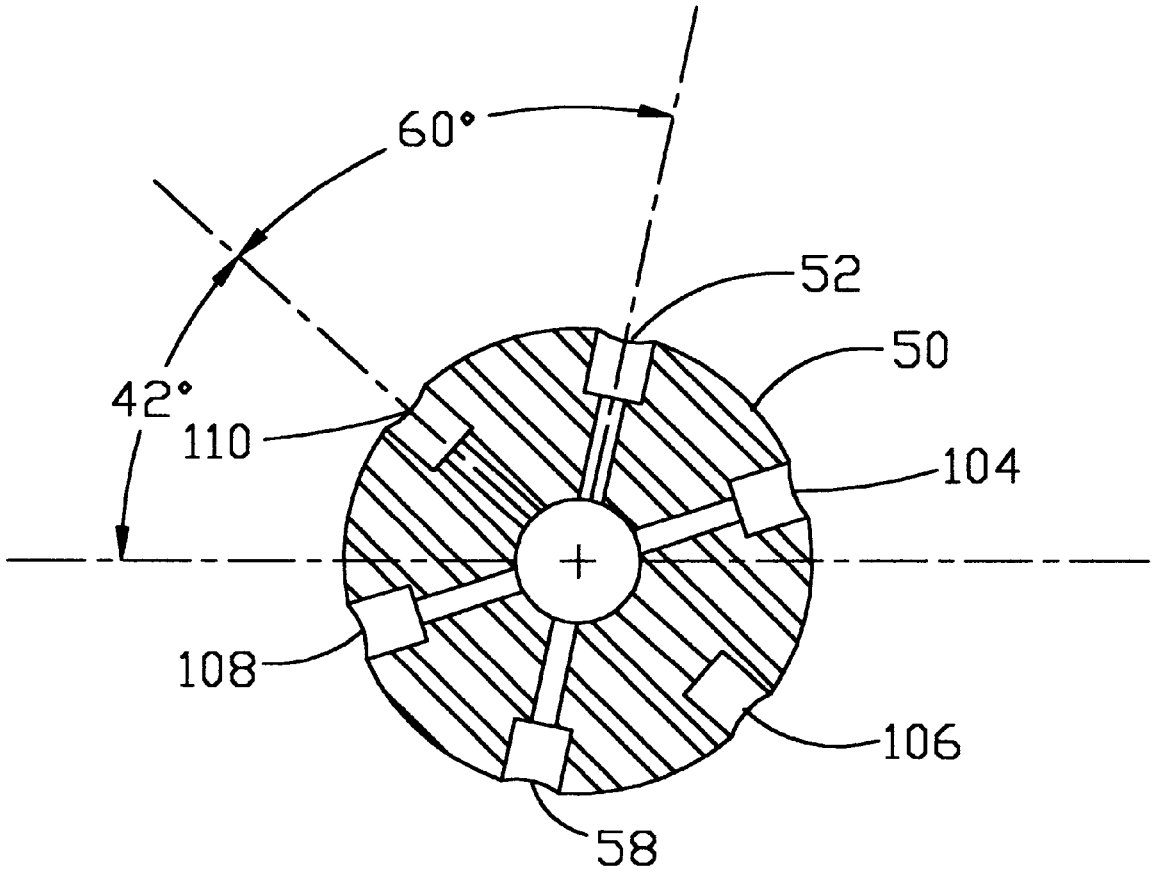
FIG. 6 is a cross-sectional view of the cylindrical member of FIG. 2 taken along line D—D.
Figure 7:
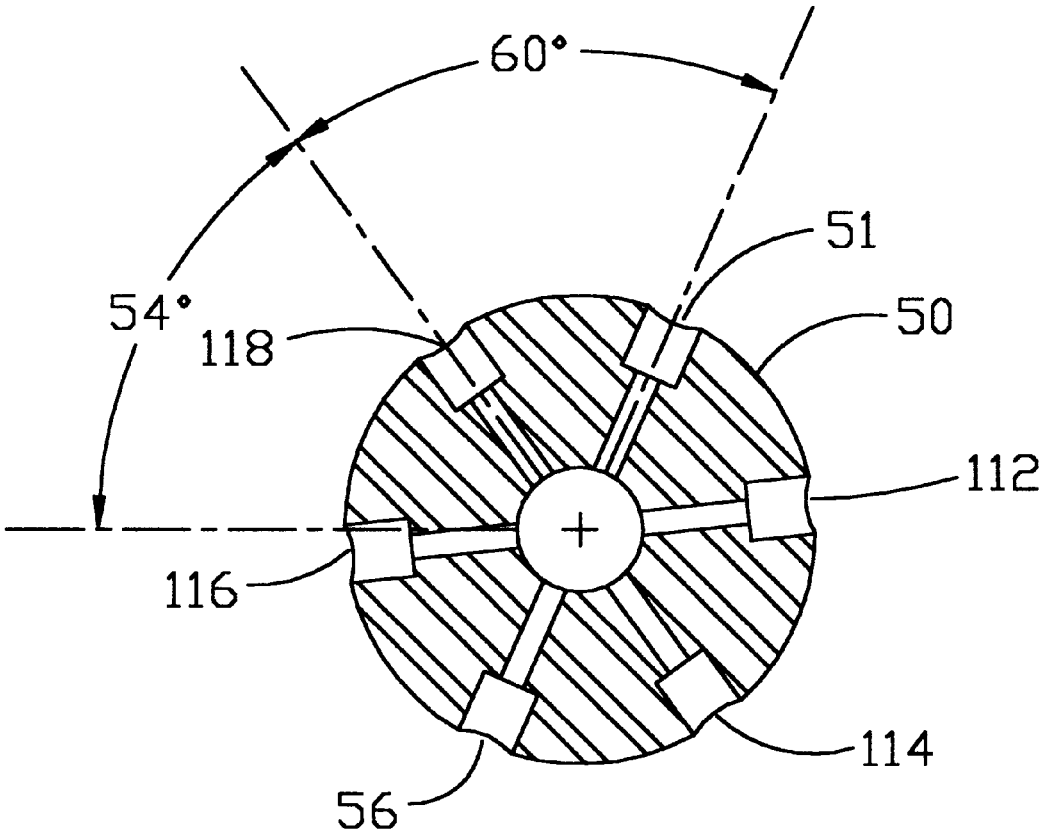
FIG. 7 is a cross-sectional view of the cylindrical member of FIG. 2 taken along line E—E.

The FIG. 5 depicts a cross-sectional view of the cylindrical member 4 taken along line C—C from FIG. 2. Thus, the nozzles 96, 98, 100, 102, 26, 28 are illustrated. The FIG. 6 depicts a cross-sectional view of the cylindrical member 4 taken along line D—D from FIG. 2. Thus, the nozzles 104, 106, 108, 110, 52, 58 are illustrated. The FIG. 7 depicts a cross-sectional view of the cylindrical member 4 taken along line E—E from FIG. 2. Thus, the nozzles 112, 114, 116, 118, 54, 56 are illustrated.

Figure 8:
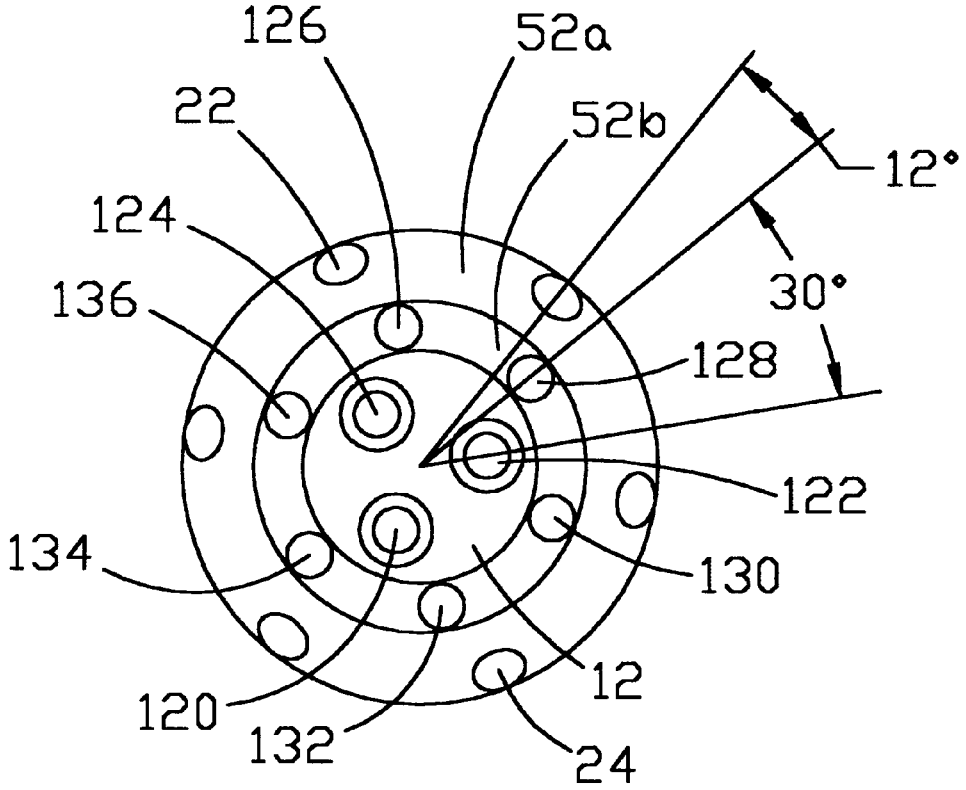
FIG. 8 is a front view of cylindrical member of FIG. 2.

Referring now to FIG. 8, a front view of the cylindrical member end 12 will now be described. The end 12 contains the nozzles 120, 122, 124. The chamfered surface 52*b* contains the nozzles 126, 128, 130, 132, 134, 136. Lastly, the chamfered surface 52*a* contains the nozzles 22, 24 along with the nozzles 138, 140, 142, 144. The majority of nozzles seen in FIG. 8 are directed generally facing in a downward direction relative to the center of axis 148 of the cylindrical member 4 and thus the fluid exiting the throat will be directed generally in a downward mode relative to the center of axis 148 and end face 12.

Figure 9:
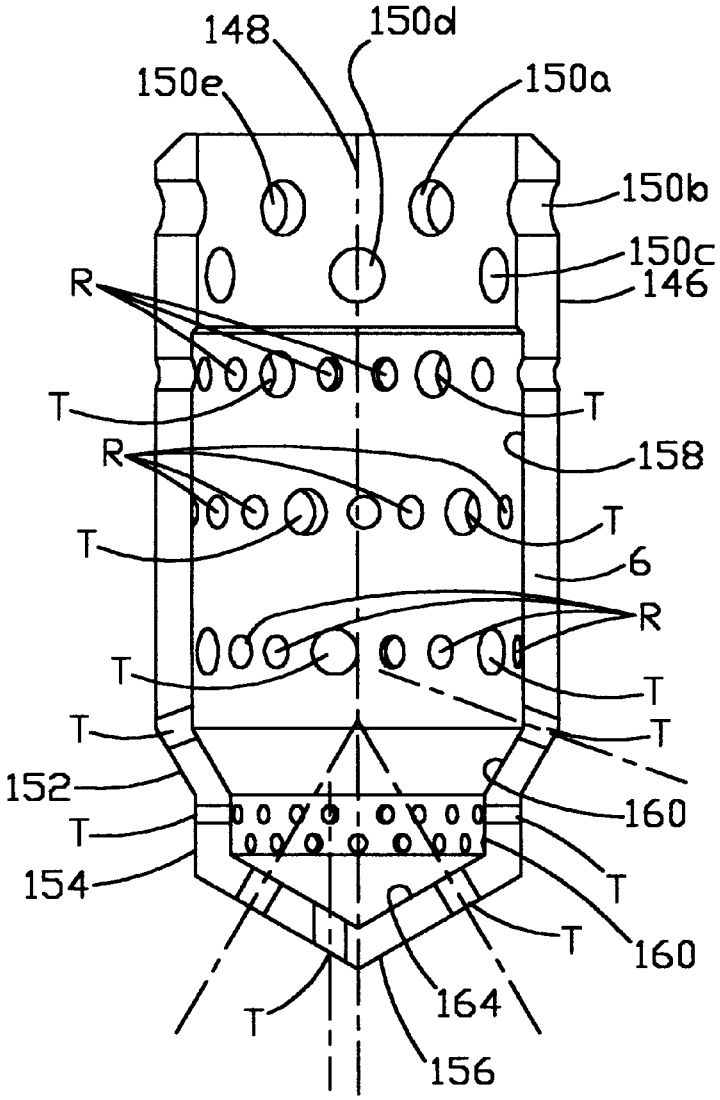
FIG. 9 is a cross-sectional view of the outer sleeve seen in FIG. 1.

The outer sleeve 6 will now be described with reference to FIG. 9. The cross-sectional view of the outer sleeve 6 includes the outer diameter surface 146. The outer sleeve 6 will contain a plurality of throats and recirculation ports. The throats are denoted by the letter "T" and the recirculation ports by the letter "R". The throats T will be operatively associated with and positioned in front of the nozzle exit as will be more fully explained later in the application. The recirculation ports R allow the fluid within the second annulus area 18 to enter the first annulus area 16. The center axis of the cylindrical member is denoted by the numeral 148. The outer sleeve also contains the passages 150*a*, 150*b*, 150*c*, 150*d*, 150*e* which correspond with the indentations 68,70,76,78,80,82,84,86,88,90,92,94 for purposes of mounting a pin therein for affixing the outer sleeve 6 to the member 4.

The outer diameter surface 146 extends to the first chamfered surface 152 which in turn extends to the second outer diameter surface 154 that in turn terminates at the conical end surface 156. The outer diameter portion 146 has a corresponding inner diameter bore 158 that extends to the chamfered inner surface 160 which extends to the second inner diameter bore 162 that terminates at the conical end surface 164.

Figure 10:
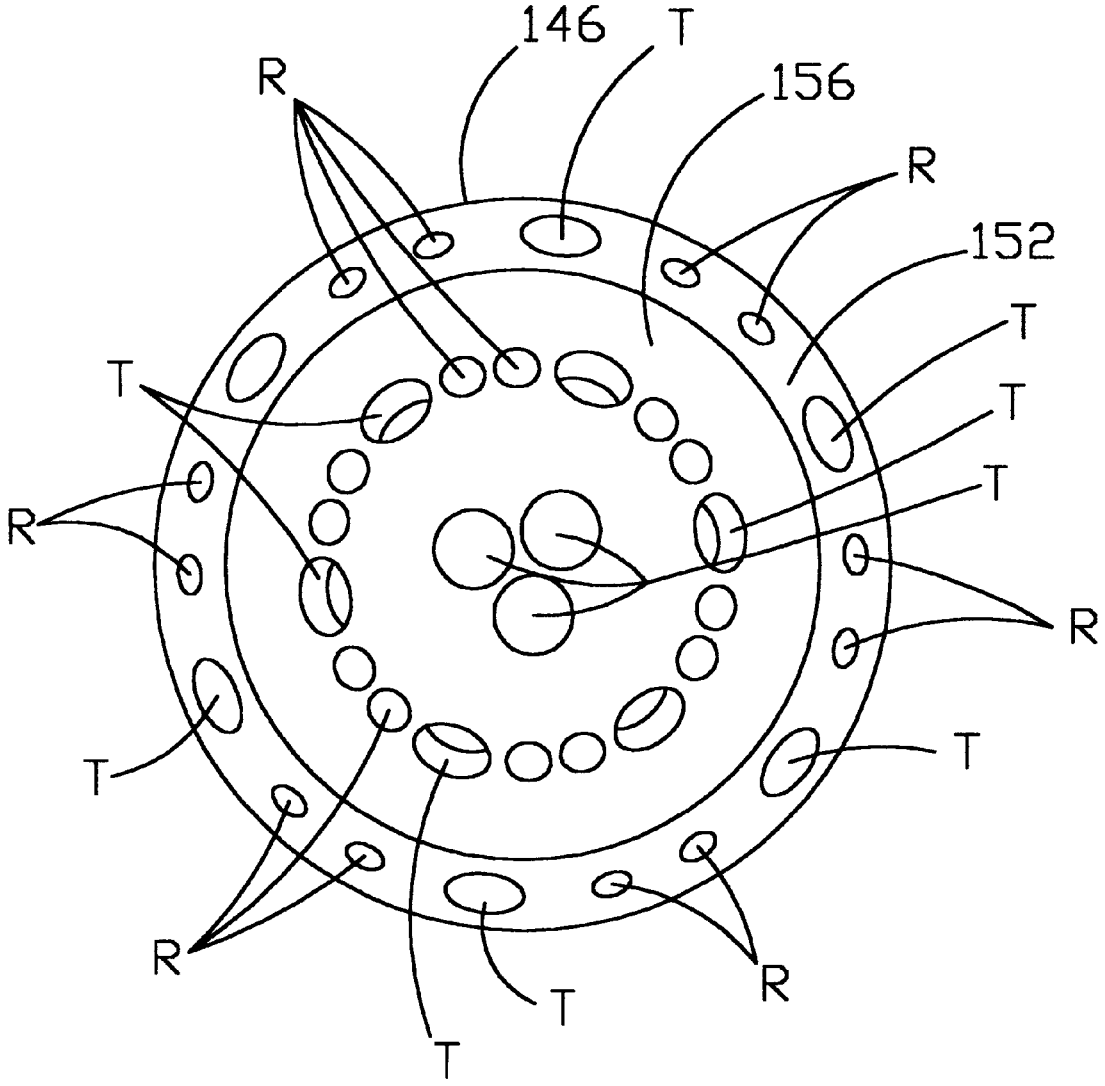
FIG. 10 is a front view of the outer sleeve seen in FIG. 10.

The end face of the outer sleeve 6 is depicted in FIG. 10. The end face consist of the conical end surface 156 that extends to the first chamfered surface 152. The recirculation ports R are denoted on the FIG. 10 as well as the throats T. Thus, the jetting of the fluid may occur radially outward from the center axis 148 to the inner diameter wall of the tubular member, longitudinally downward relative to the center axis 148 as well as at an angle relative to the center axis 148. In the embodiment shown, the larger diameter openings are the throats and the smaller diameter openings are the recirculation ports, even though it is to be understood that the exact diameter of the throats, nozzles and ports may vary depending on the exact application.

Figure 11:
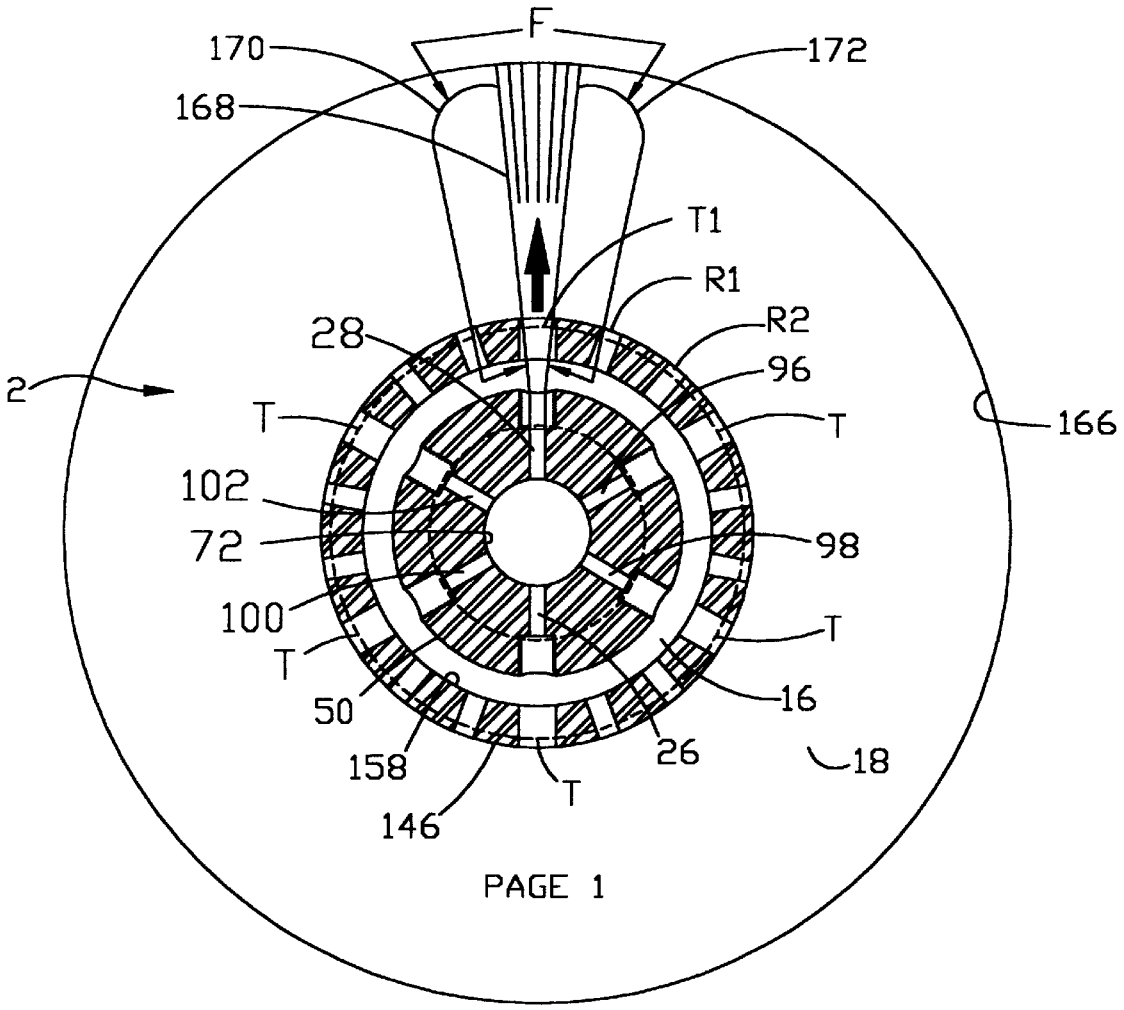
FIG. 11 is a cross-sectional view of the preferred embodiment of the present invention depicting the flow pattern taken along line AA—AA of FIG. 1.

With reference to FIG. 11, a view of the apparatus taken along line AA—AA of FIG. 1 will now be described. This view depicts the flow pattern of the apparatus 2 in operation. As shown, the apparatus 2 is disposed within a tubular member, with inner diameter wall of the tubular member being denoted as 166. Thus, the fluid and/or air (also referred to as the power medium) is pumped down the inner bore 72, with the fluid and/or air being force out of the nozzle 28. In the preferred embodiment, the power medium will be a fluid.

The annulus area 16 is at a low pressure as compared to the power medium exiting the nozzle as well as the fluid within the annulus 18, which is sometimes referred to as the venturi effect. The fluid that is within the annulus area 16 is drawn into the throat. Fluid within the annulus area 18 is also being drawn into the annulus area 16 via the recirculation ports.

In the throat T1, the power medium and the annular fluid mix, and momentum is transferred from the power medium to the annular fluid, causing an energy rise in it. By the end of the throat T1, the power medium and annular fluid are intimately mixed, but they are still at a high velocity, and the mixture contains significant kinetic energy.

The flow exiting the throat is denoted by the numeral 168, which strikes the inner diameter wall 166 of the tubular member. Therefore, the inner diameter 166 can be washed and/or treated in accordance with the teachings of the present invention. If the tubular member contains perforations, the perforations may also be washed and/or treated.

The path of the recirculated fluid, which would include any chemicals and debris, is shown by the arrow 170, 172. In the case wherein the power medium contains a treating chemical, the inner diameter 166 is throughly coated with the chemical and/or fluid, and the jetting of the debris actually aids in scouring the inner walls. The treating chemical becomes throughly mixed with the annular fluid during the operation. Due to the physical placement of the plurality of nozzles and corresponding throats, the jetting takes places along and about the length of the apparatus 2. The length of the apparatus, number of nozzles/throats, physical alignment, and physical placement may be varied depending on the type of agitation and washing action required.

Figure 12:
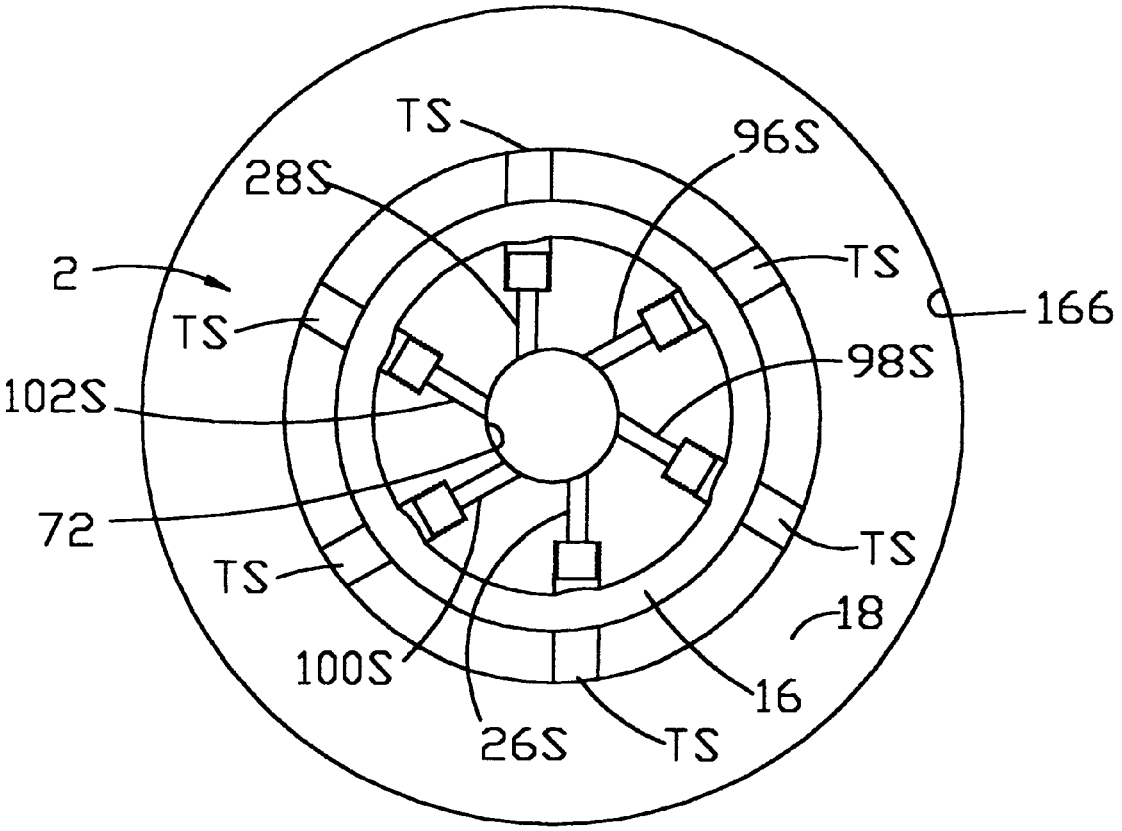
FIG. 12 is a cross-sectional view of a second embodiment of the present invention.

FIG. 12 depicts a second embodiment of the apparatus 2. This second embodiment includes nozzles and throats that are situated at an off set angle relative to the center axis 148. This off set angle (also referred to as an inclined angle) will cause the fluid exiting the throats T to a have a swirling action within the annulus 18. Thus, the offset nozzles 28*s*, 96*s*, 98*s*, 26*s*, 100*s*, and 102*s* are included. The corresponding offset throats "Ts" are also illustrated. The operation is similar to the operation of the apparatus 2 of FIGS. 1–11 except that the fluid exiting the throats will be directed at a slant so that a swirling action is maintained.

Because many varying and different embodiments may be made within the scope of the inventive concept therein taught, and because many modifications may be made in the embodiments herein detailed in accordance with the descriptive requirement of the law, it is to be understood that the details herein are to be interpreted as illustrative and not in a limiting sense.

I claim:

1. An apparatus for jetting a fluid within a tubular string having an inner diameter wall, said apparatus comprising:

a cylindrical member having an outer portion and an inner portion;

an outer sleeve disposed about said cylindrical member forming a first annulus area relative to said cylindrical member and a second annulus area relative to the inner diameter wall;

venturi means for jetting the fluid against the inner diameter walls of the tubular string, wherein said venturi means comprises: a plurality of nozzle members disposed within said cylindrical member and in communication with said inner portion and configured to deliver the fluid from the inner portion to said outer portion and a plurality of throats formed within said outer sleeve, and wherein said plurality of throats are aligned with said plurality of nozzle members and wherein the fluid from said annulus is mixed within said plurality of throats;

a plurality of re-circulation ports disposed through said outer sleeve for communicating the fluid from said second annulus to said first annulus and back into said plurality of throats.

2. The apparatus of claim 1 wherein said plurality of nozzles are inclined at an off set angle relative to the cylindrical member's center of axis.

3. The apparatus of claim 2 wherein said plurality of throats are inclined at an off set angle relative to the cylindrical member's center of axis and cooperating with said plurality of nozzles.

4. The apparatus of claim 1 wherein at least one of said plurality of nozzles is directed radially outward toward the tubular string's inner diameter wall and wherein at least one of said plurality of nozzles is directed 90 degrees downward relative to the cylindrical member's center of axis to project longitudinally downward.

5. The apparatus of claim 1 wherein said cylindrical member is connected to a drill string concentrically placed within the tubular string.

6. The apparatus of claim 1 wherein said cylindrical member is connected to a coiled tubing string concentrically placed within the tubular string.

7. An apparatus for washing a cylindrical container, said cylindrical container having a fluid therein, said apparatus comprising:

a cylindrical member concentrically disposed within said cylindrical container, said cylindrical member having an outer portion and an inner portion;

a plurality of nozzles inserted within said cylindrical member, said plurality of nozzles communicating the inner portion of said cylindrical member with the outer portion of said cylindrical member;

an outer sleeve concentrically disposed about said cylindrical member forming a first annulus area relative to said cylindrical member and a second annulus area relative to said cylindrical container and wherein said plurality of nozzles communicate said inner portion of said cylindrical member with said outer portion with said cylindrical member;

and wherein said outer sleeve contains a plurality of passages forming a plurality of throats, said plurality of throats being aligned with said plurality of nozzles so that the fluid is delivered from said inner portion to said first annulus and into said plurality of throats;

and wherein said outer sleeve contains a plurality of re-circulation ports for communicating the fluid from said second annulus area into said first annulus and back into said second annulus area via said plurality of throats.

8. The apparatus of claim 7 wherein said plurality of nozzles are oriented at an off set angle relative to a center of axis of said cylindrical member.

9. The apparatus of claim 8 wherein said plurality of passageways forming said plurality of throats are oriented at an off set angle relative to the center of axis of said cylindrical member and aligned with said plurality of nozzles.

10. The apparatus of claim 8 wherein said plurality of nozzles comprises a nozzle having a bore with a tapered end.

11. The apparatus of claim 7 wherein at least one of said plurality of nozzles faces radially outward toward the container's inner walls and wherein at least one of said plurality of nozzles is projected longitudinally downward relative to the center of axis of said cylindrical member.

12. The apparatus of claim 7 wherein said container is a tubular string and wherein said cylindrical member is connected to a drill string concentrically placed within the tubular string.

13. The apparatus of claim 7 wherein said container is a tubular string and wherein said cylindrical member is connected to a coiled tubing string concentrically placed within the tubular string.

* * * * *